US009199763B2

(12) United States Patent
Dunwoody et al.

(10) Patent No.: US 9,199,763 B2
(45) Date of Patent: Dec. 1, 2015

(54) CAN END

(75) Inventors: Paul Robert Dunwoody, Oxon (GB); Laure Helene Marie Paillet, Barenton-sur-Serre (FR)

(73) Assignee: Crown Packaging Technology, Inc., Alsip, IL (US)

( * ) Notice: Subject to any disclaimer, the term of this patent is extended or adjusted under 35 U.S.C. 154(b) by 386 days.

(21) Appl. No.: 12/812,157

(22) PCT Filed: Jan. 13, 2009

(86) PCT No.: PCT/EP2009/050326

§ 371 (c)(1),
(2), (4) Date: Jul. 8, 2010

(87) PCT Pub. No.: WO2009/090171

PCT Pub. Date: Jul. 23, 2009

(65) Prior Publication Data

US 2011/0186575 A1 Aug. 4, 2011

(30) Foreign Application Priority Data

Jan. 18, 2008 (EP) ..... 08150424

(51) Int. Cl.
*B65D 17/34* (2006.01)
*B65D 41/32* (2006.01)
*B65D 17/00* (2006.01)

(52) U.S. Cl.
CPC ..... *B65D 17/163* (2013.01); *B65D 17/165* (2013.01); *B65D 2517/0016* (2013.01); *B65D 2517/0079* (2013.01)

(58) Field of Classification Search
CPC ..... B65D 17/163; B65D 17/165; B65D 2517/0014; B65D 2517/0079; B65D 2517/0016
USPC ..... 220/269, 270, 906, 273; 413/12, 14, 413/15–17
See application file for complete search history.

(56) References Cited

U.S. PATENT DOCUMENTS 601,787 A 4/1898 Bloch
1,570,732 A 1/1926 Emerson
(Continued)

FOREIGN PATENT DOCUMENTS

DE 2540362 3/1977
EP 0088185 9/1983
(Continued)

OTHER PUBLICATIONS

Definition of "Offset", Webster's New World Dictionary, 3rd College Edition, 1988.
(Continued)

*Primary Examiner* — Fenn Mathew
*Assistant Examiner* — James N Smalley
(74) *Attorney, Agent, or Firm* — Baker & Hostetler LLP

(57) ABSTRACT

This invention relates to a can end (1) providing improved tab access for a consumer. A further aspect of the present invention relates to a container incorporating such a can end (1). The can end (1) includes a moveable portion (30) located beneath all or part of the handle (20*b*) of the can end, with the moveable portion deformable from an 'up' position (30*a*) to a 'down' position (30*b*) to provide increased tab access for a consumer. The can end (1) is provided with one or more downwardly inclined annular steps (31), which has been found to greatly increase the force required to deform the panel from the 'down' to the 'up' position, therefore resulting in a far greater likelihood of the consumer receiving a container (40) incorporating the can end (1) with the moveable portion (30) in the 'down' position (30*b*), thereby facilitating tab access.

26 Claims, 8 Drawing Sheets

(56) References Cited

U.S. PATENT DOCUMENTS

| | | | | |
|---|---|---|---|---|
| 2,054,066 | A | 9/1936 | Samuel et al. | |
| 2,124,959 | A | 7/1938 | Vogel | |
| 2,261,117 | A | 11/1941 | Jack, Jr. | |
| 2,759,307 | A | 8/1956 | Eolkin | |
| 2,971,671 | A | 2/1961 | Shakman | |
| 3,152,711 | A | 10/1964 | Mumford et al. | |
| 3,160,302 | A | 12/1964 | Chaplin | |
| D200,021 | S | 1/1965 | Bozek | |
| 3,221,924 | A | 12/1965 | Harvey et al. | |
| 3,369,689 | A | 2/1968 | Dodge | |
| 3,400,853 | A | 9/1968 | Kjell | |
| 3,401,821 | A | 9/1968 | Bozek | |
| 3,404,801 | A | 10/1968 | Silver | |
| 3,477,608 | A | 11/1969 | Fraze | |
| D219,370 | S | 12/1970 | Saunders | |
| 3,559,843 | A | 2/1971 | Kern | |
| D221,930 | S | 9/1971 | Saunders | |
| 3,643,833 | A | 2/1972 | Fraze et al. | |
| 3,650,387 | A | 3/1972 | Hornsby et al. | |
| 3,662,916 | A | 5/1972 | Holk | |
| D224,209 | S | 7/1972 | Kinkel et al. | |
| 3,674,171 | A | 7/1972 | Fahlbusch | |
| 3,703,979 | A | 11/1972 | Douty | |
| 3,704,140 | A | 11/1972 | Petit et al. | |
| D226,071 | S | 1/1973 | Saunders | |
| D226,073 | S | 1/1973 | Wesphal | |
| 3,724,709 | A | 4/1973 | Westphal | |
| 3,744,662 | A | 7/1973 | Zundel | |
| 3,762,596 | A | 10/1973 | Henning et al. | |
| 3,779,417 | A | 12/1973 | Klein | |
| 3,838,788 | A | 10/1974 | Stargell | |
| 3,839,843 | A | 10/1974 | Stewart, Jr. | |
| 3,863,801 | A | 2/1975 | Pillnik | |
| 3,905,513 | A | 9/1975 | Klein | |
| 3,929,251 | A | 12/1975 | Urmston | |
| 3,930,592 | A * | 1/1976 | Dilanni | 220/270 |
| 3,938,696 | A | 2/1976 | Herbst | |
| 3,941,277 | A | 3/1976 | McKinney et al. | |
| 3,950,592 | A | 4/1976 | Hahn et al. | |
| 3,951,299 | A | 4/1976 | Khoury | |
| 3,952,911 | A | 4/1976 | Bozek et al. | |
| 3,967,752 | A | 7/1976 | Cudzik | |
| 3,986,633 | A | 10/1976 | Jordan | |
| D243,833 | S | 3/1977 | Markert | |
| 4,015,744 | A | 4/1977 | Brown | |
| 4,030,631 | A | 6/1977 | Brown | |
| 4,150,777 | A | 4/1979 | Cyr et al. | |
| 4,205,760 | A | 6/1980 | Hasegawa | |
| 4,252,247 | A | 2/1981 | Asbury | |
| 4,266,688 | A | 5/1981 | Reid | |
| D263,803 | S | 4/1982 | Fraze | |
| 4,333,581 | A | 6/1982 | Flansburg | |
| 4,361,244 | A | 11/1982 | Walter | |
| 4,369,888 | A | 1/1983 | Walter | |
| 4,397,400 | A | 8/1983 | Walter | |
| 4,442,950 | A | 4/1984 | Wilson | |
| 4,458,469 | A | 7/1984 | Dunn | |
| 4,463,866 | A | 8/1984 | Mandel | |
| 4,503,989 | A | 3/1985 | Brown et al. | |
| D278,980 | S | 5/1985 | Brown et al. | |
| 4,524,879 | A | 6/1985 | Fundom et al. | |
| 4,557,398 | A | 12/1985 | Hambleton et al. | |
| 4,559,729 | A | 12/1985 | White | |
| 4,571,978 | A | 2/1986 | Taube et al. | |
| 4,674,649 | A | 6/1987 | Pavely | |
| 4,680,917 | A | 7/1987 | Hambleton et al. | |
| 4,701,090 | A | 10/1987 | Smith | |
| 4,716,755 | A | 1/1988 | Bulso et al. | |
| 4,722,215 | A | 2/1988 | Taube et al. | |
| 4,747,511 | A | 5/1988 | Dutt et al. | |
| 4,836,398 | A | 6/1989 | Leftault, Jr. et al. | |
| D307,720 | S | 5/1990 | Saunders | |
| D312,404 | S | 11/1990 | Bray et al. | |
| 5,011,037 | A | 4/1991 | Moen et al. | |
| D321,326 | S | 11/1991 | Harwood | |
| 5,064,087 | A | 11/1991 | Koch | |
| 5,069,356 | A | 12/1991 | Zysset | |
| 5,169,017 | A | 12/1992 | Cooper et al. | |
| D332,402 | S | 1/1993 | Harwood et al. | |
| 5,199,618 | A | 4/1993 | Reil et al. | |
| 5,307,947 | A | 5/1994 | Moen et al. | |
| 5,335,808 | A | 8/1994 | Lee | |
| D352,898 | S | 11/1994 | Vacher | |
| 5,502,995 | A | 4/1996 | Stodd | |
| 5,581,978 | A | 12/1996 | Hekal et al. | |
| 5,593,063 | A | 1/1997 | Claydon et al. | |
| 5,622,273 | A | 4/1997 | Kelly | |
| D382,481 | S | 8/1997 | McEldowney | |
| 5,671,860 | A | 9/1997 | Louwerse et al. | |
| 5,685,189 | A | 11/1997 | Nguyen et al. | |
| 5,730,314 | A | 3/1998 | Wiemann et al. | |
| 5,743,445 | A | 4/1998 | Benarrouch | |
| 5,749,257 | A | 5/1998 | McEldowney | |
| 5,804,237 | A * | 9/1998 | Diamond et al. | 426/131 |
| 5,813,561 | A | 9/1998 | Chang et al. | |
| 5,947,317 | A | 9/1999 | Hall | |
| 6,024,239 | A | 2/2000 | Turner et al. | |
| D421,907 | S | 3/2000 | Benge et al. | |
| 6,059,137 | A | 5/2000 | Westwood et al. | |
| 6,089,072 | A | 7/2000 | Fields | |
| 6,105,806 | A | 8/2000 | Stasiuk | |
| D432,015 | S | 10/2000 | Holiday | |
| 6,138,856 | A | 10/2000 | Ghim et al. | |
| 6,202,881 | B1 | 3/2001 | Chiang | |
| 6,206,220 | B1 | 3/2001 | Stodd | |
| 6,290,447 | B1 | 9/2001 | Siemonsen et al. | |
| 6,427,861 | B1 | 8/2002 | Cho | |
| 6,702,538 | B1 | 3/2004 | Heinicke et al. | |
| 6,723,360 | B1 | 4/2004 | Dunaway | |
| D520,358 | S | 5/2006 | Heinicke | |
| 7,168,586 | B2 | 1/2007 | Jeon | |
| 7,174,762 | B2 | 2/2007 | Turner et al. | |
| 7,305,861 | B2 | 12/2007 | Turner et al. | |
| 7,341,163 | B2 | 3/2008 | Stodd | |
| D565,406 | S | 4/2008 | Foskett | |
| D568,741 | S | 5/2008 | Foskett | |
| 7,407,061 | B2 | 8/2008 | Fares et al. | |
| D579,771 | S | 11/2008 | Cherian | |
| 7,500,376 | B2 | 3/2009 | Bathurst et al. | |
| 7,617,945 | B2 | 11/2009 | Cherian | |
| 7,909,196 | B2 | 3/2011 | Turner et al. | |
| 8,104,319 | B2 | 1/2012 | Turner et al. | |
| 2002/0113069 | A1 | 8/2002 | Forrest et al. | |
| 2003/0110736 | A1 | 6/2003 | Boyd | |
| 2004/0259235 | A1 | 12/2004 | Fares et al. | |
| 2005/0150889 | A1 | 7/2005 | Perra | |
| 2005/0210835 | A1 | 9/2005 | Tamis | |
| 2005/0224497 | A1 | 10/2005 | Wook | |
| 2005/0263481 | A1 | 12/2005 | Tanaka et al. | |
| 2006/0060582 | A1 | 3/2006 | Martinez | |
| 2007/0068943 | A1 | 3/2007 | Ramsey | |
| 2007/0108209 | A1 | 5/2007 | Jeon et al. | |
| 2007/0215620 | A1 | 9/2007 | Kasper | |
| 2007/0278230 | A1 | 12/2007 | McEldowney et al. | |
| 2008/0078764 | A1 | 4/2008 | McEldowney et al. | |
| 2008/0110888 | A1 | 5/2008 | Turner et al. | |
| 2008/0197132 | A1 | 8/2008 | Hasegawa et al. | |
| 2008/0314906 | A1 | 12/2008 | Butcher et al. | |
| 2010/0021270 | A1 | 1/2010 | McEldowney et al. | |
| 2010/0116374 | A1 | 5/2010 | Wilson et al. | |
| 2010/0287886 | A1 | 11/2010 | Saucedo et al. | |

FOREIGN PATENT DOCUMENTS

| | | |
|---|---|---|
| EP | 1577222 | 9/2005 |
| EP | 1919786 | 5/2008 |
| EP | 1958882 A1 | 8/2008 |
| FR | 2826939 | 1/2003 |
| GB | 1316484 | 5/1973 |
| GB | 1533959 | 11/1978 |
| GB | 23 200 08 A | 6/1998 |
| JP | 61-48128 | 3/1986 |
| JP | 01182247 | 7/1989 |
| JP | 04044950 | 2/1992 |

(56) References Cited

FOREIGN PATENT DOCUMENTS

| | | |
|---|---|---|
| JP | 2002-160733 | 6/2002 |
| JP | 2003-054549 | 2/2003 |
| JP | 2003-112735 | 4/2003 |
| JP | 2004-182256 | 7/2004 |
| KR | 2000-17742 | 4/2000 |
| NL | 7416818 | 7/1975 |
| WO | WO 01/28875 | 4/2001 |
| WO | WO 02/08074 | 1/2002 |
| WO | WO 03/104092 | 12/2003 |
| WO | WO 2006/112765 | 10/2006 |
| WO | WO 2007/039367 | 4/2007 |
| WO | WO 2008/098761 A1 | 8/2008 |

OTHER PUBLICATIONS

U.S. Appl. No. 12/465,894, filed May 14, 2009, Saucedo.
U.S. Appl. No. 61/113,490, filed Nov. 11, 2008, Hall.
"Advertisement for Boa Housewares', Canpull", The Canmaker, Jun. 2002, vol. 15, 2 pages.
"Advertisement for Buhrke Tech's New End Opens Easier and Costs Less to Make", The Canmaker, Jan. 1998, vol. 11, 4 pages.
"Cannex Asia's Seamlingly Endless Possibilities", The Canmaker, Feb. 2003, vol. 16, 2 pages.
"Contains 100% of Your Daily EOE Requirements", The Canmaker, Jul. 2000, vol. 13, 3 pages.
"Heinz Takes the Easy Way", The Canmaker, Jun. 1999, vol. 12, 5 pages.
"HL Foods Chooses Easy-Open Ends", The Canmaker, Nov. 1999, vol. 12, 4 pages.
"Impress Grabs Heinz Contract", The Canmaker, Jul. 1999, vol. 12, 6 pages.
"Interesting Openings, Part 3", The Canmaker, Sep. 1999, vol. 12, 2 pages.
"Modelling Helps Easy-Open End Choice", The Canmaker, Apr. 2003, vol. 16, 3 pages.
"New Generation of Easy Open Ends", The Canmaker, Oct. 1998, vol. 11, 2 pages.
"Stacking Giant in France", The Canmaker, Mar. 1998, vol. 11, 3 pages.
"Tab Orientation for Better Easy-Open Performance", The Canmaker, May 2001, vol. 14, 2 pages.
"The Ergonomic and Hygienic Can-End", The Easy Can Company, The Canmaker, Apr. 1998, vol. 11, 5 pages.
"Winter Theme for Toyo's TULC Can", The Canmaker, Dec. 2002, vol. 15, 6 pages.
Bailey, "Making it Easier", The Canmaker, Dec. 1998, vol. 11, 4 pages.
Bailey, "Quality, Not Commodity", The Canmaker, Feb. 2000, vol. 13, 5 pages.
Glendenning, "Ends Are Just the Beginning", The Canmaker, Jul. 2001, vol. 11, 8 pages.
Higuera, "Into the Spotlight", The Canmaker, Jun. 2003, vol. 16, 2 pages.
Nutting, "Canned Convenience", The Canmaker, Sep. 2000, vol. 13, 4 pages.
Nutting, "Corned Beef Comes of Age", The Canmaker, Aug. 2003, vol. 16, 3 pages.
Nutting, "Legendary Success, UK Awards", The Canmaker, Nov. 2003, vol. 16, 4 pages.
Nutting, "Performance Proposal", The Canmaker, Oct. 2000, vol. 13, 4 pages.
Nutting, "The Sweet Aroma of Success", The Canmaker, Jun. 2001, vol. 14, 3 pages.
Nutting, "Thinner, Lighter, Easier", The Canmaker, Nov. 2000, vol. 13, 3 pages.
Nutting, "Uncrowned Champs", The Cammaker, Aug. 2001, vol. 14, 3 pages.
Nutting, "Uphill Struggle", The Canmaker, Jul. 2003, vol. 16, 4 pages.
Page, "The Rigours of Processing", The Canmaker, Jan. 1999, vol. 12, 3 pages.
Pye, "Visible Benefits . . . Easy Does it", The Canmaker, Jun. 1998, vol. 11, 4 pages.
Searle, "A Century of Ends", The Canmaker, Jul. 2006, vol. 19, 4 pages.
Supplementary European Search report dated Jul. 30, 2007, issued in EP patent application No. 03730882, now EP publication No. 1919786.

* cited by examiner

CAN END

CROSS-REFERENCE TO RELATED APPLICATIONS

This application is the National Stage of International Application No. PCT/EP2009/050326 filed Jan. 13, 2009, which claims the benefit of EP application number 08150424.3, filed Jan. 18, 2008, the disclosures of which are incorporated herein by reference in their entirety.

TECHNICAL FIELD

This invention relates to a can end providing improved tab access for a consumer. A further aspect of the present invention relates to a container incorporating such a can end.

BACKGROUND ART

In the field of metal packaging, easy open ends for metal cans are well known. Typically, an easy open can end takes the form of a metal panel including a score line defining an opening area on the can end. A tab is provided on the can end, with lifting of the tab by a consumer initiating fracture of the score line and subsequent pulling on the tab resulting in opening of the can end about the opening area. Historically, the opening of such easy open ends was made difficult by limited clearance between the tab and the can end, thereby making it hard for a consumer to engage the tab with their fingers. WO 03/104092 A (MAEIL DAIRY INDUSTRY CO., LTD) 18.12.2003 (subsequently assigned to CROWN Packaging Technology, Inc for US and EP designations) provided a solution to this problem, with the can end including a collapsible protrusion located beneath the tab. The collapsible protrusion of WO 03/104092 A is deformable from an upward position to a downward position. In the upward position, the can ends are readily stackable for transportation (i.e. before being attached to a container), but provide little or no clearance between the can end and the tab. When deformed into the downward position (typically after being attached to a can body), the protrusion then provides clearance between the tab and can end to enable a user to engage their fingers with the tab and open the can.

However, it has been found that during subsequent handling of containers incorporating can ends of the type described in WO 03/104092 A (i.e. after filling and any retort processing), there can be a tendency for the protrusion to "pop up" back into its upward position, thereby hindering tab access for a consumer. The cause of the popping-up could be, for example, impacting of the container against other containers or being dropped onto the floor. Similarly, the protrusion could pop back up when transported at high altitudes, where the lower atmospheric pressure would result in a lower pressure differential between the inside and outside of the container.

Consequently, there is a need for an improved easy open can end providing increased assurance of maintaining tab access for a consumer.

DISCLOSURE OF INVENTION

Accordingly, there is provided an easy open can end suitable for attachment to a container body, comprising:

a central panel formed with a score line, and a tab attached to the can end, the score line defining the periphery of an openable panel portion on the central panel, the tab having a nose portion and a handle portion, the central panel further comprising a moveable portion extending under all or part of the handle portion of the tab, the moveable portion having:

an "up" position: where the moveable portion is convex when viewed from above the can end; and a "down" position: where the moveable portion is concave when viewed from above the can end, the moveable portion being deformable from the up position to the down position, characterised in that the moveable portion includes at least one downwardly inclined annular step.

For the avoidance of any doubt, by "convex" is meant that all or part of the moveable portion protrudes generally upwardly from the central panel. Similarly, by "concave" is meant that all or part of the moveable portion protrudes generally downwardly from the central panel. Therefore, the moveable portion need not define a perfectly smoothly curved surface as would be found in the lens of a camera.

Typically, it would be expected that in the "down" position, a gap would thereby be defined between the handle portion of the tab and the moveable portion which is suitable for enabling finger access by a user.

For the purposes of the present invention, the "openable panel portion" includes both of the following types of can end:

i. where the openable panel portion is entirely detachable from the can end on opening; and/or ii. where part of the openable panel portion is retainable by the can end after opening.

In each case, severing of the score line defines an aperture on the can end through which product may be dispensed.

Can ends of type (i) are particularly common for food applications; for example, for products which contain solid chunks or viscous material that cannot easily be poured. In these cases, it is desirable to maximise the size of the aperture to enable easy dispensing of food products. In this case, the nose portion of the tab would typically be situated adjacent the score line so that lifting of the handle of the tab would cause the nose portion of the tab to sever the score line.

Can ends of type (ii) are often used for beverage applications for which a smaller aperture is desirable to enable the product to be drunk or poured straight from the can. The smaller aperture size makes it practical for the openable panel portion to be retained by the can end; e.g. by being folded inwards into the container body. The retaining of the openable panel portion reduces litter.

The moveable portion may be located radially inward or outward of the score line. The location of the moveable portion would be dependent on the type of can end. For example, where the score line defines an aperture covering nearly all of the area of the central panel (i.e. a so-called "full-aperture" can end), both the moveable portion and the tab would be formed on the openable panel portion, i.e. inwards of the score line. Alternatively, where the score line defines an aperture covering only part of the area of the central panel (i.e. a so-called "partial aperture" can end, as is found on beverage cans), it may be practicable for the moveable portion and tab to be provided outward of the score line.

Conveniently, the moveable portion is formed as an integral part of the can end. It has been found beneficial to use a press to form the moveable portion in the material of the can end. In simple terms, the moveable portion results in a can end which is bi-stable. By "bi-stable", it is meant that the moveable portion can adopt one of two different states: the "up" (convex) position, and the "down" (concave) position. However, it has been found that incorporating the downwardly inclined annular step of the present invention provides additional stiffening to the moveable portion. The stiffening effect is such that it increases the force required for the moveable portion to "pop-up" from the down position to the up position, relative to the same can end without the annular step. As the stiffening effect due to the annular step increases, the moveable portion behaves more like a mono-stable end in that once the moveable portion has been deformed into its "down" (concave) position, it is highly resistive to being deformed back into an "up" (convex) position. Further, this increase in stiffening is achieved without increasing the thickness of the metal used to form the can end. Increasing the metal thickness would result in increased material costs. In summary, when used on a container body, the present invention results in a container better able to withstand impacts and/or transportation at high altitudes (where the atmospheric pressure is reduced), without the moveable portion of the can end reverting or popping back into the "up" (convex) position. Therefore, there is a greater likelihood of a consumer receiving a container/can end providing adequate tab access for a consumer's finger. Whilst the can end may remain bi-stable, the annular step results in a higher force being required to deform the moveable portion back into the "up" (convex) position, i.e. an increase in the "pop-up" force.

For the purposes of the present invention, by "annular" is meant extending through at least 180° angular extent.

Conveniently, the annular step is formed as continuous without break or gap; for example, describing the shape of a concentric circle, an ellipse or being irregular in shape when viewed in plan. However, alternatively the annular step may be formed as a series of two or more discontinuous step portions each separated by a gap, the step portions together describing an annular step. Advantageously, one or more of the discontinuous step portions are radially dispersed from each other. More preferably, the discontinuous step portions are circumferentially dispersed from each other; for example, an annular step may be made up of several discontinuous step portions that together define the general shape of a circle, with the circumferential gaps in the "circle" being responsible for the discontinuous nature of the annular step. A combination of radial and circumferential gaps may be used to separate each of the discontinuous step portions. Preferably, the annular step—whether continuous or discontinuous—is formed to occupy a substantially common plane. Where there are a plurality of annular steps located one inside the other, each annular step is preferably formed to occupy its own respective plane.

Although it is possible for two or more annular steps to be formed in the moveable portion, tests detailed in Table 1 below have demonstrated a significant increase in "pop-up" force (relative to a can end without an annular step) with the use of only a single downwardly inclined annular step.

The can end of the present invention may be manufactured with the moveable portion initially in either the "up" position or the "down" position. Where the can ends are transported between locations for later attachment to a can body, it is preferred that the moveable portion is deformed into the "up" position because this allows for easy stackability of the can ends.

To demonstrate the effectiveness of the annular step, tests were performed using two distinct designs of can end of 73 mm nominal diameter made of 0.21 mm gauge, double-reduced (DR) tinplate to material specification DR550N and incorporating a moveable portion. The moveable portion was provided by a protrusion which was formed in the central panel of the can end by a press. The only differences in the design of each can end were that in the first design (Design 'A') the protrusion did not include an annular step; and in the second design (Design 'B') the protrusion included a single, downwardly inclined annular step. The annular step employed was in the form of a continuous concentric circle (when viewed in plan from above the can end). The tests established the nominal pressure required to cause the protrusion to:

i. pop down from the "up" (convex) position to the "down" (concave) position; and ii. pop back up into the "up" (convex) position.

The results are as shown in Table 1 below:

TABLE 1

| | Vacuum Pressure to "Pop-down" (mbar) | Pressure to "Pop-up" (mbar) |
|---|---|---|
| Design 'A': No Annular Step | >1000 | 350 |
| Design 'B': With Annular Step | 830 | 790 |

The table illustrates that the inclusion of a single downwardly inclined annular step (Design 'B') greatly increased the pressure differential required to cause the protrusion to "pop-up" relative to Design 'A'. It also had the effect of increasing the pressure differential required to cause "pop-down" relative to Design 'A'. In these particular tests, the annular step resulted in a 126% increase in the pressure required to cause pop-up of the protrusion.

Preferably, the downwardly inclined annular step is generally linear in cross-section. However, this is not an essential requirement and the downwardly inclined annular step may also be curved in cross-section.

Preferably, the downwardly inclined step is formed such that when the moveable portion is in the down position, the step is inclined downwardly at between 8° to 17° to the horizontal at a given location on the step.

In a further embodiment, it has been found preferable for the step to be inclined downwardly at between 8° to 17° to the horizontal, with an axial depth of between 0.007 inches to 0.013 inches (measured along the central axis of the can end) at a given location on the step.

Where the annular step is curved in cross-section, the angle of inclination of the step would be measured between the uppermost and lowermost points for a given location on the step.

It is an essential requirement for the downwardly inclined annular step to be located on or to extend onto the moveable portion itself. In order to maximise the force required to cause "pop-up", it has been found preferable for the annular step to be located near the periphery of the moveable portion. Conveniently, the annular step is formed at a location on or between the periphery of the moveable portion and a distance of up to 50% radially inwardly of the periphery of the moveable portion. Locating the annular step close to the centre of the moveable portion would have the disadvantage of reducing the stiffening effect provided by the annular step and would result in a lower increase in pop-up pressure.

The annular step is preferably circular in plan because this shape maximises the force required to cause the moveable portion to pop back up into the "up" (convex) position. In other words, it has been found to provide the optimum stiffening effect. However, other profiles for the annular step (e.g. elliptical or irregular in plan) may also be used.

Although it is generally envisaged that the annular step(s) will conveniently be in the form of one or more continuous concentric circles, in an alternative embodiment, the downwardly inclined annular step may be provided as a spirally-formed annular step when viewed from above. When implemented on the moveable portion of the present invention, the spiral would more correctly be known as a conic helix, i.e. a hybrid of both a spiral and a helix. In its simplest form, the moveable portion includes a single spirally-formed annular step. However, there may also be multiple spirally-formed annular steps. Advantageously, there are two annular steps, each annular step provided as a spirally-formed annular step, the spirally-formed steps being wound in contra-directional relationship to each other. Regardless of whether a single or multiple spirally-formed annular step(s) are used, the effect of the spiral configuration will be to cause the moveable portion to behave more like a mono-stable end in that once the moveable portion has been deformed into its "down" (concave) position, it is highly resistive to being deformed into an "up" (convex) position.

Conveniently, the can end would include a seaming panel to enable the end to be seamed to a can body by conventional means (for example, by double seaming). Conveniently, the can end comprises an upwardly inclined wall at the periphery of the central panel, the wall extending laterally to form the seaming panel to enable the can end to be seamed onto a can body.

In a second aspect of the invention there is provided a container comprising the can end of the present invention attached to a container body.

BRIEF DESCRIPTION OF FIGURES IN THE DRAWINGS

Various embodiments of the invention are described with reference to the following drawings.

MODE(S) FOR CARRYING OUT THE INVENTION

Figure 1:
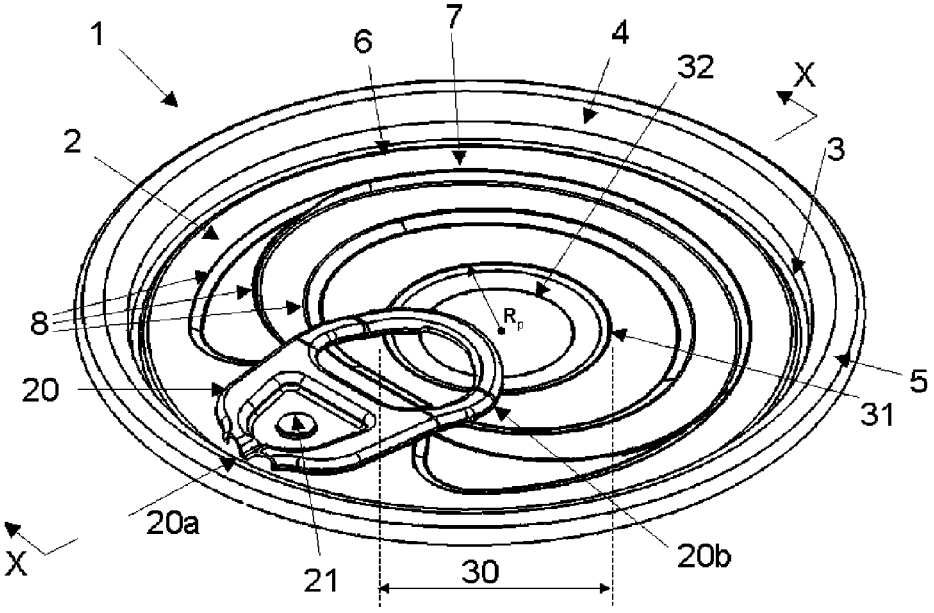
FIG. 1 shows a top perspective view of a first embodiment of can end according to the present invention.

FIG. 1 shows can end 1. In the embodiment shown, the can end 1 is formed of 0.21 mm gauge DR550N material. The can end 1 has a central panel 2 with a countersink 3 at its periphery. The countersink 3 extends upwardly into a chuck wall 4, with the chuck wall extending radially outwards to form a seaming panel 5. A circular score line 6 is formed in the can end 1, defining an openable panel portion 7 inwards of the score line. The score line 6 (once severed) defines an aperture through which product (not shown) is dispensed, with the openable panel portion 7 being completely detachable from the can end 1. Beading 8 is provided on the central panel 2 for the purpose of strengthening the central panel 2.

A tab 20 is attached to the central panel 2 by means of a rivet 21. One end of the tab 20 is provided with a nose portion 20*a* situated adjacent to the score line 6. The opposite end of the tab 20 is provided with a handle portion 20*b* in the form of a ring.

A moveable portion is provided on the can end 1 as a protrusion 30. The protrusion 30 is formed by the use of a press (not shown) acting on the material of the can end 1. The protrusion 30 is generally circular in plan and of radius $R_p$—as shown in FIG. 1.

Figure 2:
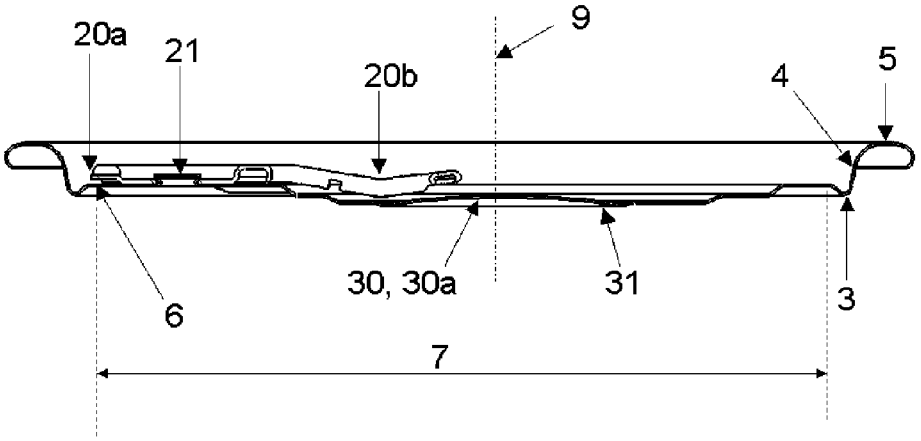
FIG. 2 shows a cross-section view in the direction of arrows X-X for the can end of FIG. 1, with moveable portion in an "up" (convex) position.
Figure 3:
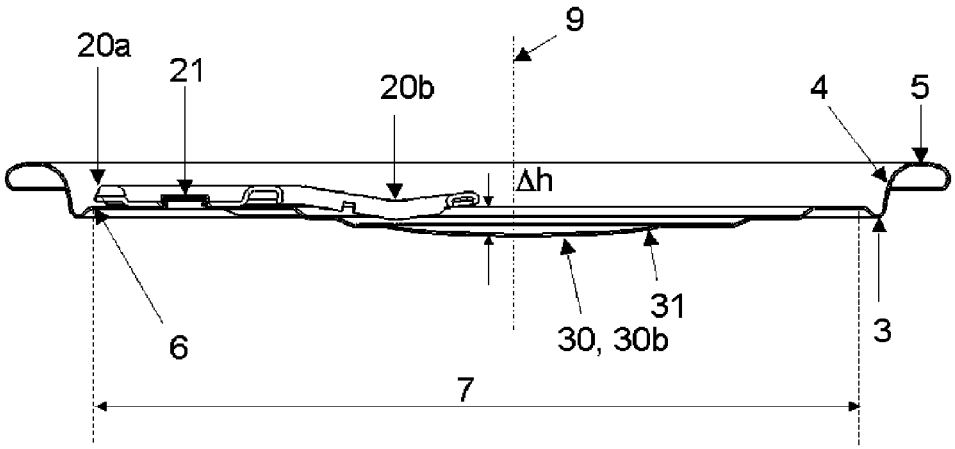
FIG. 3 shows a cross-section view in the direction of arrows X-X for the can end of FIG. 1, with moveable portion in a "down" (concave) position.
Figure 4:
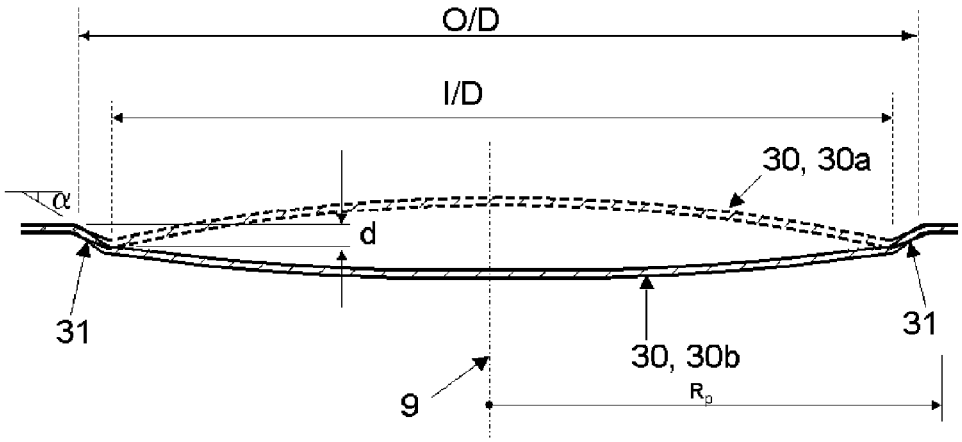
FIG. 4 shows a detail cross-section view of the moveable portion and annular step of the can end of FIG. 1, showing the moveable portion in both "up" (convex) and "down" (concave) positions.

The protrusion 30 can revert between two different states: in one state it would be in an "up" position, have a convex profile 30*a* when viewed from above the can end (see FIGS. 2 & 4); in the other state it would be in a "down" position, having a concave profile 30*b* when viewed from above the can end 1 (see FIGS. 3 & 4); Mechanical means (not shown) may be used to cause the protrusion to revert from one state to another, i.e. "pop-up" or "pop-down". Alternatively, in-can pressure differentials may be used to cause the protrusion to revert from one state to another; for example, where the can end is attached to container body, negative pressure may be used to suck or pull down the protrusion.

A downwardly inclined annular step 31 is provided at the periphery of the protrusion 30 and is also circular in plan. As stated earlier in the general disclosure of the invention, in an alternative embodiment the annular step 31 may instead be located some distance radially inwards of the periphery of the protrusion 30, whilst still being effective in increasing the pop-up force of the protrusion relative to a similar can end without the annular step.

In the example shown in the figures (see especially FIG. 4), the annular step 31 is inclined downwardly at an angle '$\alpha$' of 12.5° to the horizontal and defines an axial depth 'd' of 0.010 inches (0.025 mm) measured along the central axis 9 of the can end 1. These measurements are taken with the protrusion 30 in the "down" (concave) position 30*b*. In the embodiment shown, the annular step 31 defines an outer diameter 'O/D' of 0.950 inches (24.1 mm) and an inner diameter 'I/D' of 0.860 inches (21.8 mm). In the embodiment shown in FIGS. 1 to 6, the above dimensions are uniform about the entire annular step.

Line 32 (see FIG. 1) represents a witness mark resulting from the forming process of the press used to form the protrusion 30. In this embodiment, the witness mark 32 is functionally insignificant to the performance of the can end.

On leaving the press (not shown), the protrusion 30 of the can end 1 is initially in the "down" (concave) position 30*b* (as shown in FIGS. 3 & 4). However, where the can ends 1 are to be transported between different sites for later fixing to a can body (for example, where a filler attaches the can end to the can body), mechanical or other means (not shown) would be used to apply an upward force to the protrusion 30 so that the protrusion reverts or clicks into the "up" (convex) position 30*a* prior to transportation (see FIGS. 2 & 4). The reason for this is because the can end 1 is most efficiently stacked with the protrusion 30 in the "up" position 30*a*, with the recess formed by the protrusion 30 providing space for the tab of an underlying can end.

In an alternative embodiment, the protrusion 30 may initially be formed in the press in the "up" (convex) position 30*a* (as shown in FIGS. 2 & 4). As can be seen in FIG. 2, with the protrusion 30 in this "up" position, there is limited/no clearance between the handle portion 20*b* of the tab 20 and the can end 1. However, as referred to in the above paragraph, in this condition the can ends are easy to stack, which is particularly good when transporting can ends in bulk.

Figure 5:
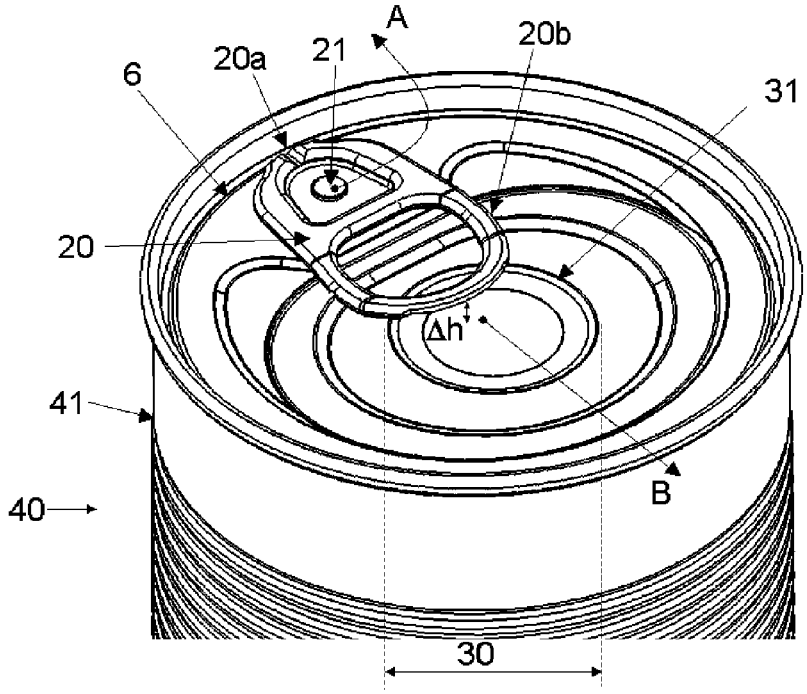
FIG. 5 shows a perspective view of the can end of FIG. 1 when seamed onto a container body.
Figure 6:
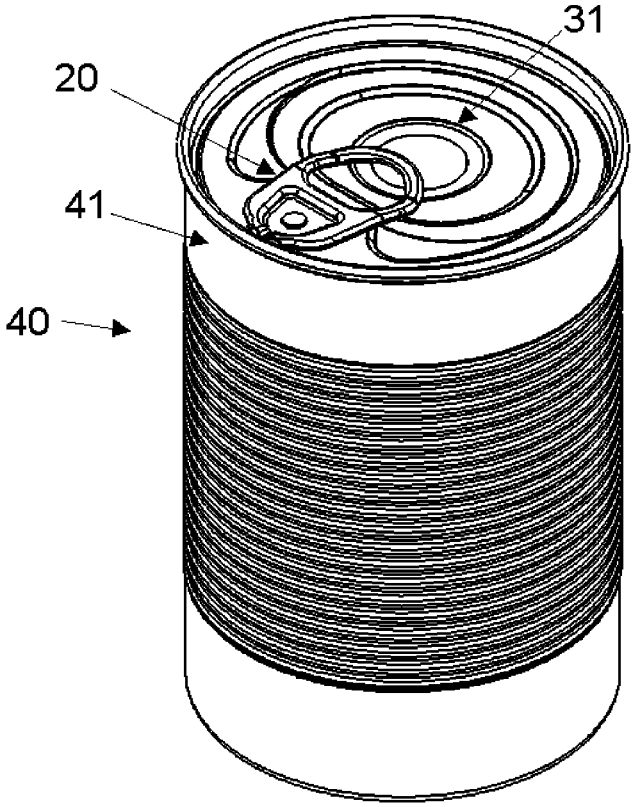
FIG. 6 shows a further perspective view of the can end of FIG. 1 when seamed onto a container body.

FIGS. 5 & 6 shows a container 40 resulting from seaming of the can end 1 onto a metal can body 41. If not already done, the protrusion 30 is pressed/clicked into the "down" (concave) position before attachment of the can end 1 onto the can body 41. Alternatively, in-can negative pressure can be used to suck or pull the protrusion into the "down" (concave) position; for example, by careful control of filling and processing conditions. The container 40 is shown in FIG. 5 with the protrusion 30 in its "down" (concave) position 30*b*, resulting in a gap Δh between the handle portion 20*b* and the protrusion 30 of approximately 2 mm (see FIGS. 3 & 5). As previously discussed, it is intended that a consumer should receive the container 40 with the protrusion 30 remaining in the "down" (concave) position, because this maximises tab access and consequently, ease of opening. The presence of the downwardly inclined annular step 31 and the consequent increase in pop-up force provides assurance against 'popping-up' of the protrusion 30, even when the container 40 is subjected to impacts with adjacent containers or other objects, or transported at high altitudes (for example, at altitudes of around 5,250 feet above sea level, which is typical of Denver, USA).

In use, a consumer (not shown) would engage their fingers with the handle portion 20*b* of the tab 20 to first lever the tab upwardly (in the direction of arrow A—see FIG. 5) about the rivet 21 to cause the nose portion 20*a* to initiate rupture of the score line 6. Thereafter, the consumer would pull back on the tab 20 (in the direction of arrow B—see FIG. 5) to propagate tearing of the remainder of the score line 6 and cause removal of the openable panel portion 7 from the can end 1.

In the embodiment shown, the openable panel portion 7 is completely separable from the can end 1 and defines an aperture covering nearly all the area of the can end (i.e. a so-called "full-aperture" end), with the protrusion 30 and the tab 20 defined on this openable panel portion. The embodiment shown is particularly suitable for cans containing food products, where the size of the aperture and, by implication, the portion 7 needs to be maximised.

However, in another embodiment, the openable panel portion 7 may instead extend over only a minor part of the area of the can end 1, with the protrusion 30 defined outwards of the openable panel portion and score line 6. This embodiment would be particularly suitable for beverage applications, where a relatively small pouring aperture is desirable.

Figure 7:
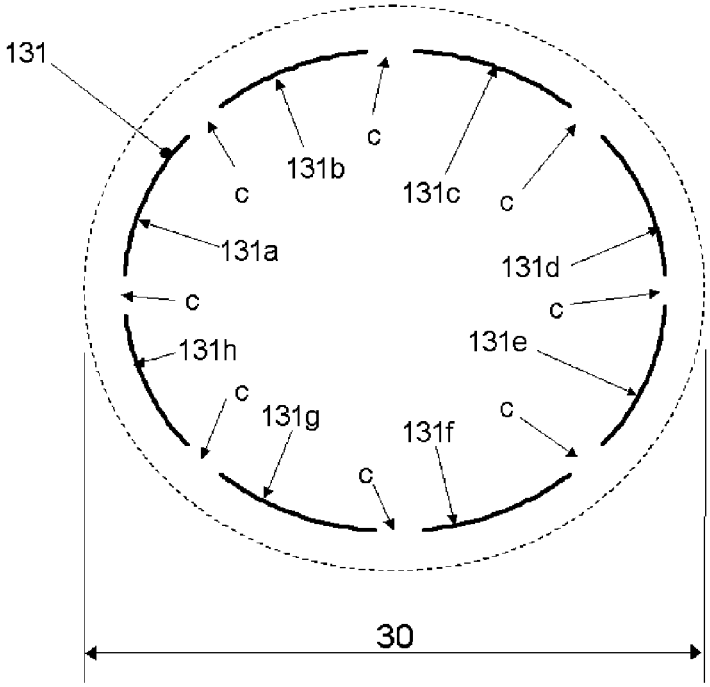
FIG. 7 shows a plan view of a second embodiment of moveable portion, the moveable portion having an annular step made up of circumferentially-dispersed discontinuous step portions.

FIG. 7 shows a plan view of a can end localised to the area of the moveable portion 30, but showing a different configuration of downwardly inclined annular step 131. In the embodiment of FIG. 7, the annular step 131 is made up of several discontinuous step portions 131*a-h*, each separated by a circumferential gap 'c' (i.e. the step portions 131*a-h* are circumferentially-dispersed relative to each other). The discontinuous step portions together define a generally circular profile when viewed in plan, with each of the step portions occupying a common radial location. Together, the discontinuous step portions 131*a-h* extend through a full revolution (i.e. 360°). A thick line is used to represent the path of each of the discontinuous step portions 131*a-h*.

Figure 8:
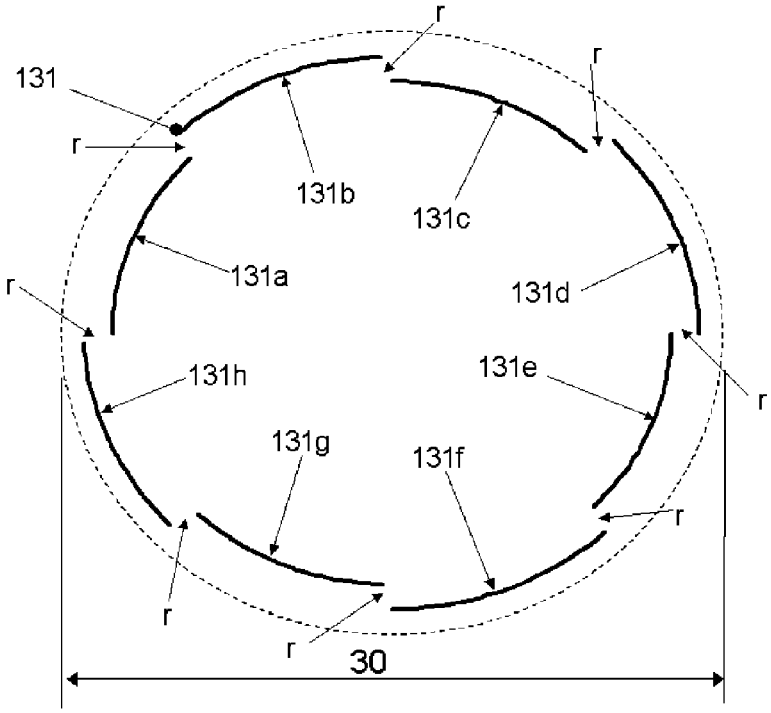
FIG. 8 shows a plan view of a third embodiment of moveable portion, the movable portion having an annular step made up of radially-dispersed discontinuous step portions.

The embodiment of FIG. 8 differs from that of FIG. 7 in that the discontinuous step portions 131*a-h* are radially-dispersed (see radial gap 'r') from each other in an alternate manner at two different radial locations.

Figure 9:
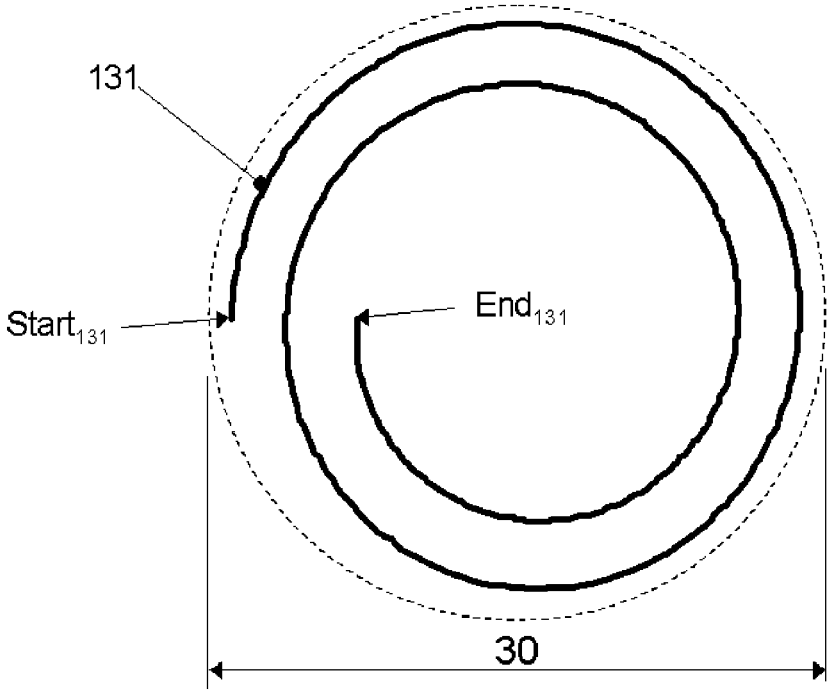
FIG. 9 shows a plan view of a fourth embodiment of moveable portion, the moveable portion having a single spirally-formed annular step.

FIGS. 9 & 10 again show plan views of a can end 1 localised to the area of the moveable portion, but showing further alternative configurations of downwardly inclined annular step to those seen in the embodiments of FIGS. 1 to 8. In the embodiment of FIG. 9, the moveable portion 30 has a downwardly inclined annular step provided as a single spirally-formed annular step 131 when viewed from above the can end. A thick line is used to represent the path of this single spirally-formed annular step 131. The start and end points of the annular step are labelled as $Start_{131}$ and $End_{131}$ respectively.

Figure 10:
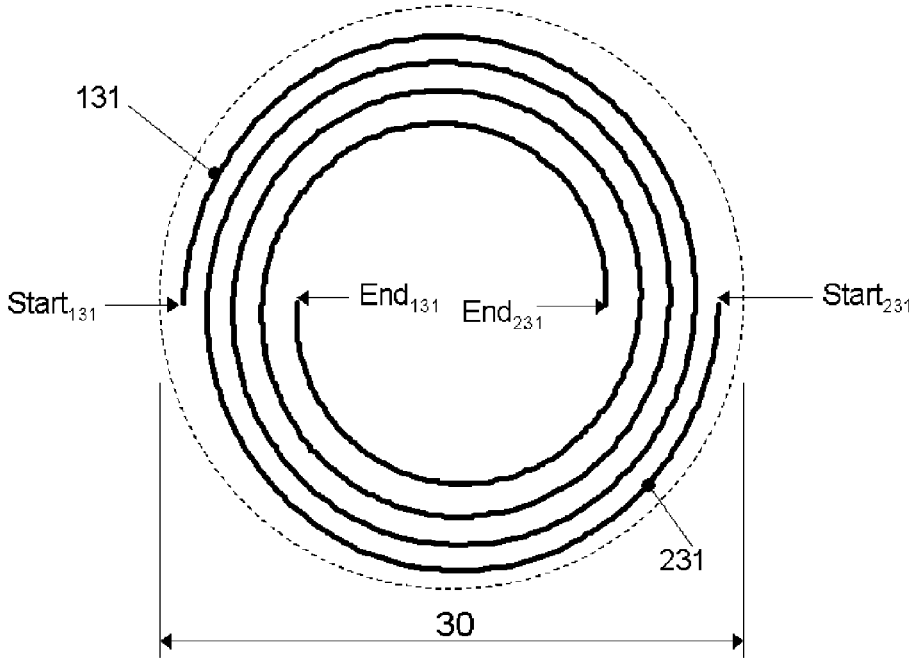
FIG. 10 shows a plan view of a fifth embodiment of moveable portion, the moveable portion having two spirally-formed annular steps.

The embodiment of FIG. 10 differs from that of FIG. 9 in having two downwardly inclined annular steps, each provided as separate spirally-formed annular steps 131, 231 wound in contra-directional relationship to each other. The start and end points of each annular step 131, 231 are labelled $Start_{131,231}$ and $End_{131,231}$ respectively.

For the embodiments shown in FIGS. 9 & 10, each spirally-formed annular step 131, 231 extends through two revolutions (i.e. 720°).

Figure 11:
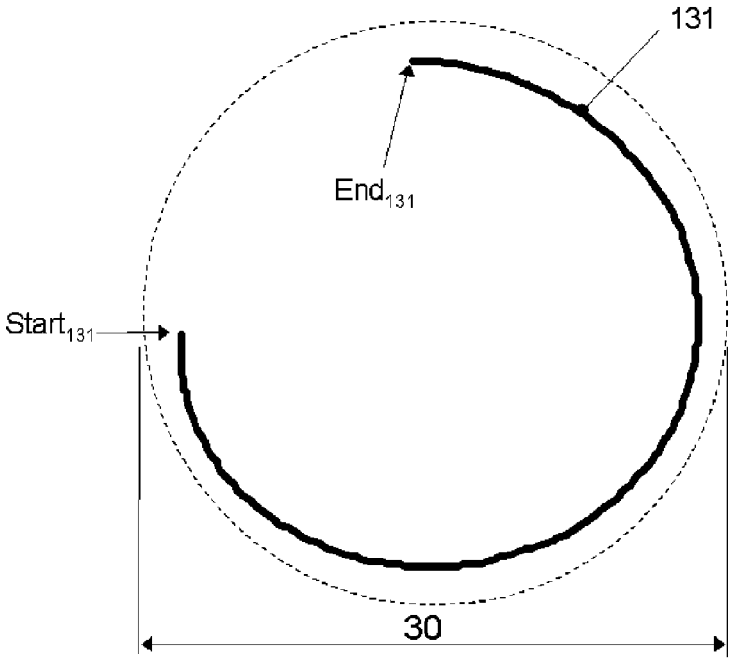
FIG. 11 shows a plan view of a sixth embodiment of moveable portion having a single spirally-formed annular step (similar to that of FIG. 9), but extending through approximately 270° angular extent.
Figure 12:
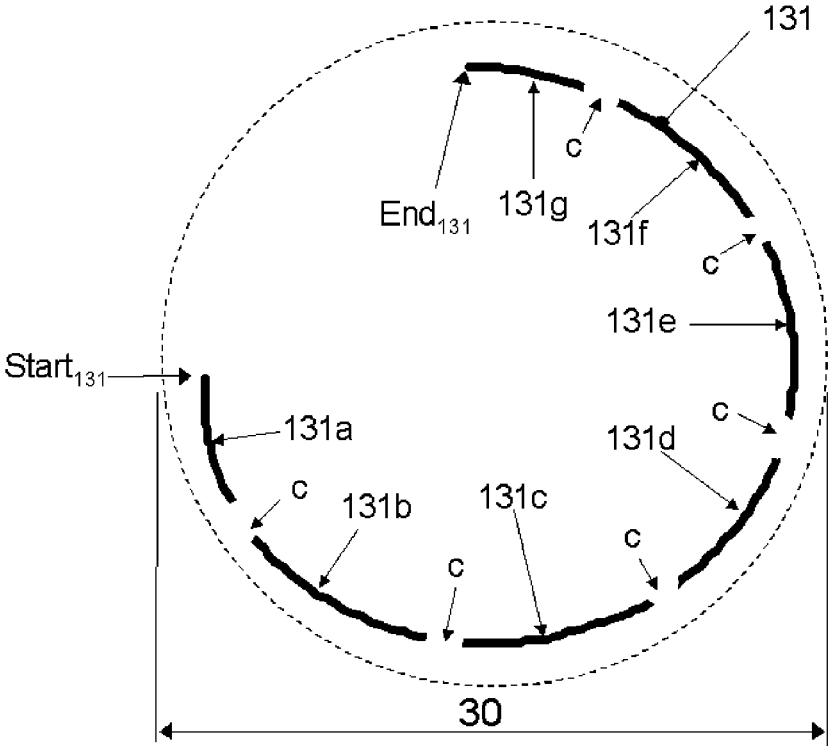
FIG. 12 shows a plan view of a seventh embodiment of moveable portion corresponding to that of FIG. 11, but with the annular step being formed of discontinuous step portions each separated by a circumferential gap.

For the further alternative embodiment shown in FIG. 11, there is a single annular step 131 (in this case, spirally-formed) extending through only 270° of a revolution. The final embodiment shown in FIG. 12 corresponds to that of FIG. 11, but with the annular step 131 being a series of seven discontinuous step portions 131*a-g* each separated by a circumferential gap 'c', the step portions together describing the annular step 131.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

The invention claimed is:

1. An easy open can end suitable for attachment to a container body, comprising:

a central panel having a score line;

a tab attached to the can end, the tab having a nose portion and a handle portion;

an openable panel portion on the central panel defined by the score line;

the openable panel portion comprising a bistable section and a downwardly inclined annular step, the bistable section disposed radially inward from the downwardly inclined annular step, the bistable section extending under all or part of the handle portion of the tab, the bistable section being deformable between:

an up position: in which at least a portion the bistable section is convex when viewed from above the can end; and a down position: in which at least a portion of the invertible bistable section is concave when viewed from above the can end such that a first gap between the tab and the bistable section is defined so as to enable finger access to the tab.

2. An easy open can end as claimed in claim 1, wherein the annular step includes a series of two or more discontinuous step portions each separated by a second gap, the step portions together comprising the annular step.

3. An easy open can end as claimed in claim 2, the discontinuous step portions are:

i. radially dispersed from each other, and/or ii. circumferentially dispersed from each other.

4. An easy open can end as claimed in claim 1, wherein the annular step is formed such that when the bistable section is in the down position, the step has a portion that, in cross section along a diameter of the can end, is flat and inclined downwardly at between 8° to 17° to the horizontal.

5. An easy open can end as claimed in claim 4, wherein the annular step is formed with an axial depth (d) of between 0.007 inches to 0.013 inches at a given location on the step.

6. An easy open can end as claimed in claim 1, wherein the annular step is formed at a location on or between the periphery ($R_p$) of the bistable section and a distance of up to 50% inwardly of the radial location of the periphery of the bistable section.

7. An easy open can end as claimed in claim 1, wherein the annular step is circular or elliptical in plan view.

8. An easy open can end as claimed in claim 1, wherein the annular step is provided as a spirally-formed annular step when viewed from above the can end.

9. An easy open can end as claimed in claim 8, further comprising a second annular step, each annular step provided as a spirally-formed annular step, the spirally-formed steps being wound in contra-directional relationship to each other.

10. An easy open can end as claimed in claim 8, further comprising a second annular step, each annular step provided as a spirally-formed annular step, the spirally-formed steps being wound in contra-directional relationship to each other.

11. An easy open can end as claimed in claim 1, wherein the annular step is circular or elliptical in plan view.

12. An easy open can end as claimed in claim 1, wherein the annular step is provided as a spirally-formed annular step when viewed from above the can end.

13. An easy open can end as claimed in claim 1, further comprising a second annular step, and at least one of the steps is formed as a series of two or more discontinuous step portions each separated by a second gap.

14. An easy open can end as claimed in claim 13, wherein the discontinuous step portions are:

i. radially dispersed from each other, and/or ii. circumferentially dispersed from each other.

15. An easy open can end as claimed in claim 1, wherein the annular step resists unintended movement from the down position to the up position.

16. The easy open can end of claim 1 wherein the bistable section is stable in at least the down position when the score line is ruptured.

17. A container comprising a can body and a can end attached to the can body, the can end including:

a central panel formed with a score line;

a tab attached to the can end, the tab having a nose portion and a handle portion;

an openable panel portion on the central panel defined by the score line;

the openable panel portion comprising a bistable section and a downwardly inclined annular step, the bistable section extending under all or part of the handle portion of the tab, the bistable section being deformable between:

an up position: in which at least a portion the bistable section is convex when viewed from above the can end; and a down position: in which at least a portion of the bistable section is concave when viewed from above the can end, such that the first gap is formed between the tab and the bistable section so as to enable finger to the tab.

18. A container as claimed in claim 17, wherein the annular step is formed as a series of two or more discontinuous step portions each separated by a second gap.

19. A container as claimed in claim 18, wherein the discontinuous step portions are:

i. radially dispersed from each other, and/or ii. circumferentially dispersed from each other.

20. A container as claimed in claim 17, wherein the annular step is formed such that when the bistable section is in the down position, the step has a flat portion that, in cross section along a diameter of the can end, is flat and inclined downwardly at between 8° to 17° to the horizontal.

21. A container as claimed in claim 20, wherein the annular step is formed with an axial depth (d) of between 0.007 inches to 0.013 inches at a given location on the step.

22. A container as claimed in claim 17, wherein the annular step is formed at a location on or between the periphery ($R_p$) of the bistable section and a distance of up to 50% inwardly of the radial location of the periphery of the bistable section.

23. A container as claimed in claim 17, further comprising a second annular step, at least one of the annular steps formed as a series of two or more discontinuous step portions each separated by a second gap.

24. A container as claimed in claim 23, wherein the discontinuous step portions are:

i. radially dispersed from each other, and/or ii. circumferentially dispersed from each other.

25. A container as claimed in claim 17, wherein the annular step resists unintended movement from the down position to the up position.

26. The container of claim 17 wherein the bistable section is stable in at least the down position when the score line is ruptured.

* * * * *